US005170839A

United States Patent [19]

Feuerstacke et al.

[11] Patent Number: 5,170,839

[45] Date of Patent: Dec. 15, 1992

[54] METHOD FOR DETERMINING AND REGULATING THE LEVEL OF A BATH OF MOLTEN METAL

[75] Inventors: Ewald Feuerstacke, Dorsten; Gerhard Stadtfeld, Kamp-Linfort, both of Fed. Rep. of Germany

[73] Assignee: Mannesmann Aktiengesellschaft, Dusseldorf, Fed. Rep. of Germany

[21] Appl. No.: 683,780

[22] Filed: Apr. 11, 1991

[30] Foreign Application Priority Data

Apr. 11, 1990 [DE] Fed. Rep. of Germany ..... 4012039

[51] Int. Cl.[5] ..... B22D 11/18; B22D 37/00

[52] U.S. Cl. ..... 164/453; 164/449; 164/475; 266/78; 266/239

[58] Field of Search ..... 164/453, 454, 452, 449, 164/413, 475; 266/78, 239; 222/590, 595

[56] References Cited

U.S. PATENT DOCUMENTS 2,889,596 6/1959 Savage et al. ..... 164/449

FOREIGN PATENT DOCUMENTS 55-149761 11/1980 Japan ..... 164/449
60-180654 9/1985 Japan ..... 164/475
62-21447 1/1987 Japan ..... 164/452
62-252649 11/1987 Japan ..... 164/453
64-2467 1/1989 Japan ..... 164/475
1282954 1/1987 U.S.S.R. ..... 164/475

*Primary Examiner*—J. Reed Batten, Jr.
*Attorney, Agent, or Firm*—Cohen, Pontani, Lieberman, Pavane

[57] ABSTRACT

An inert gas flow is introduced into a molten metal bath at a location in a vessel. The absolute pressure of the gas flow through the molten metal other than zero flow is determined. The pressure acting on the surface of the bath is measured and the difference between the surface pressure and the absolute pressure is determined. The difference in converted into a distance measurement that reflects the actual distance between the surface of the bath and the location of introduction of the gas flow into the bath. The distance measurement is compared with a predetermined desired distance value and a resultant measurement is formed therefrom. The level of the bath is regulated as a function of the resultant measurement. The resultant measurement is converted into an electric setting signal and sent to a setting member for regulating the level of the bath and/or the amount flowing out of or withdrawn from the vessel.

8 Claims, 3 Drawing Sheets

METHOD FOR DETERMINING AND REGULATING THE LEVEL OF A BATH OF MOLTEN METAL

FIELD OF THE INVENTION

The present invention relates to a method of determining and regulating the level of molten metal in a bath contained in a metallurgical vessel, particularly an open-ended mold of a casting plant, and more particularly to a method employing the measuring of a difference in pressure between an absolute pressure required to just commence bubbling of an inert gas through a tube into a bath of molten metal and the pressure that acts on the surface of the molten metal (often atmospheric pressure), and relating this calculation to a height of the molten metal for regulating the amount of molten metal in the bath.

BACKGROUND OF THE INVENTION

There are various known methods of determining the level of molten metal in a bath of molten metal. Such methods include optical, radiometric or electrodynamic means. In one such proposed method (set forth in European Application EPO 150 670 A2), eddy currents are induced and measured in the molten metal by a coil. The currents serve as a basis for determining the distance of the molten metal from the coil. From a comparison between desired and actual values, the amount of molten metal sought to be poured into the metal bath is set and obtained.

Another method, employing optical means for measurement, is described in Federal Republic of Germany OS 29 31 199. In that description, light pulses are projected by a mirror onto the surface of the bath and the reflected light pulses are detected. The travel time of the light is a measure of the distance between the surface of the bath and the optical device.

These prior art methods are both trouble-prone and very expensive.

An object of the present invention, therefore, is to provide a method for determining and regulating the level of a bath of molten metal, in which the level of the bath can be determined and regulated easily and in reproducible manner.

SUMMARY OF THE INVENTION

The foregoing object, and other objects of the instant invention are achieved by the provision of a method of determining and regulating the level of molten metal in a bath contained in a metallurgical vessel by introducing an inert gas flow through a conduit into the molten metal bath at a predetermined location in the vessel, determining an absolute pressure at a flow of said gas through said molten metal other than zero flow, measuring the pressure acting on the surface of the bath, determining the difference between the surface pressure and the absolute pressure; converting said difference measurement into a distance measurement reflecting the actual distance between the surface of the bath and the location of introduction of the gas flow into the molten metal bath, comparing the distance measurement with a predetermined desired distance value and forcing a resultant measurement therefrom; and regulating as a function of the resultant measurement one of the level of the bath and the amount of molten metal withdrawn from said vessel.

Further embodiments include converting the resultant measurement into an electric setting signal and feeding the setting signal into a setting device for regulating the level of the bath and/or of the amount flowing from or withdrawn from the vessel. A further embodiment of the invention also involves introducing the gas at the end of the molten metal pipe feed that is immersed in the molten metal bath, or introducing the gas at the bottom of the metal bath.

Thus, the method of the present invention has the advantage of being simple to employ in many locations in metal baths and casting plants.

BRIEF DESCRIPTION OF THE DRAWINGS

Other objects and many of the attendant advantages and features of the present invention will be readily appreciated and better understood by reference to, and consideration of the detailed description of the invention together with the accompanying drawings wherein like reference numerals designate like parts throughout the figures thereof, and wherein.

DETAILED DESCRIPTION OF THE INVENTION

Figure 1:
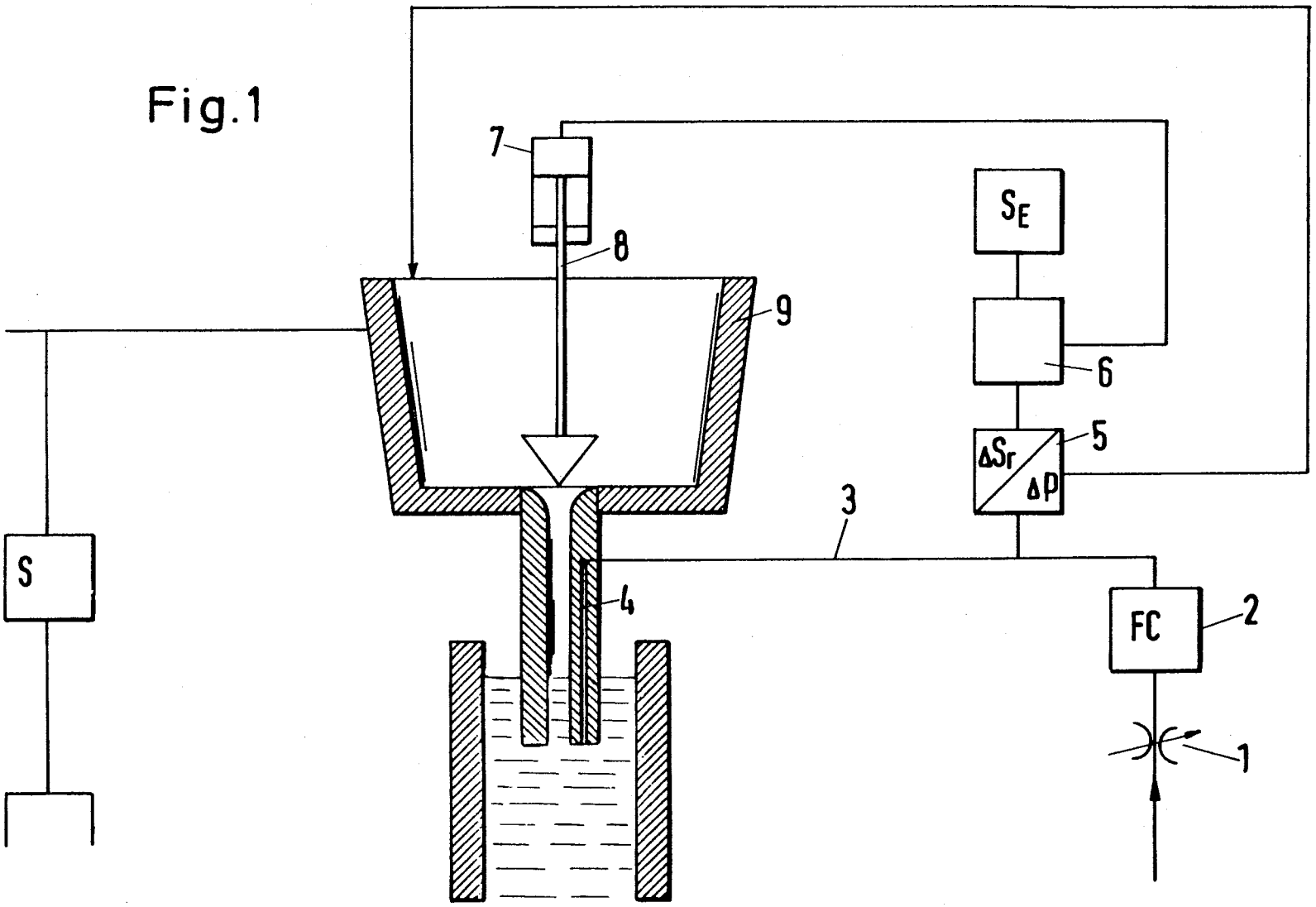
FIG. 1 is a partly schematic, partly block, and partly cross-sectional representation of an open-ended mold with regulation of the feed of the metal into the bath in accordance with a preferred embodiment of the instant invention.

In FIG. 1, a preferred method of the instant invention is shown for filling an open-ended mold in a casting plant. Inert gas is taken from a pressure vessel and fed via an adjustable throttle 1 to a continuous-flow control device 2. The inert gas next passes through the continuous-flow control device 2 and via a pipeline 3 to a tube or conduit 4 which extends into the molten metal. Such a conduit 4 can be formed by an additional bore in an immersion nozzle, the bore debouching in the immersion end into the molten metal, or by any like means in order that the terminus of conduit 4 is immersed into the molten metal bath.

The pipeline 3 is directly connected to a pressure-measuring device 5. In the event that inert gas flows into the molten metal with the formation of gas bubbles, a flow other than zero is recorded by the continuous-flow control device 2. In other words, a zero flow situation occurs when there is no gas bubbling through conduit 4 into the molten metal bath, as where the gas pressure is sufficient to merely maintain the metal at the terminus of the conduit 4, without rising within the conduit, but is not great enough to bubble into the bath. A pressure just slightly greater than the zero flow is required to commence bubbling, and also creates an absolute pressure reading recorded on the pressure-measuring device 5.

When a flow of inert gas other than zero is assured, the absolute pressure at which this flow is occurring is recorded with pressure-measuring device 5. Pressure measuring device 5 also records the pressure on the surface of the metal bath, which is often atmospheric pressure (unless, e.g., a pressure vessel is used). Pressure-measuring device 5 thus creates a measurement reflecting the distance from the level of the metal in the bath to the place of introduction of the inert gas by comparing the absolute pressure with the surface pressure.

The pressure-measuring device 5 converts the recorded pressure into an electrical signal and feeds this electrical signal to a comparator 6. From the difference between a predetermined electrical signal reflecting a desired value $S_E$ (correlating with a preferred height or quantity of metal in the bath) and the electrical signal input from the device 5, a setting signal is created by the comparator 6, and is fed to a setting member 7. This setting member 7 actuates a closure stopper 8 in a molten metal distributor 9. In this regard, it is also within the scope of the invention to employ other closure mechanisms, valves, drains, removal devices, and the like as well as employing the setting signal for controlling the rate of removal of a bar from a mold.

Figure 2:
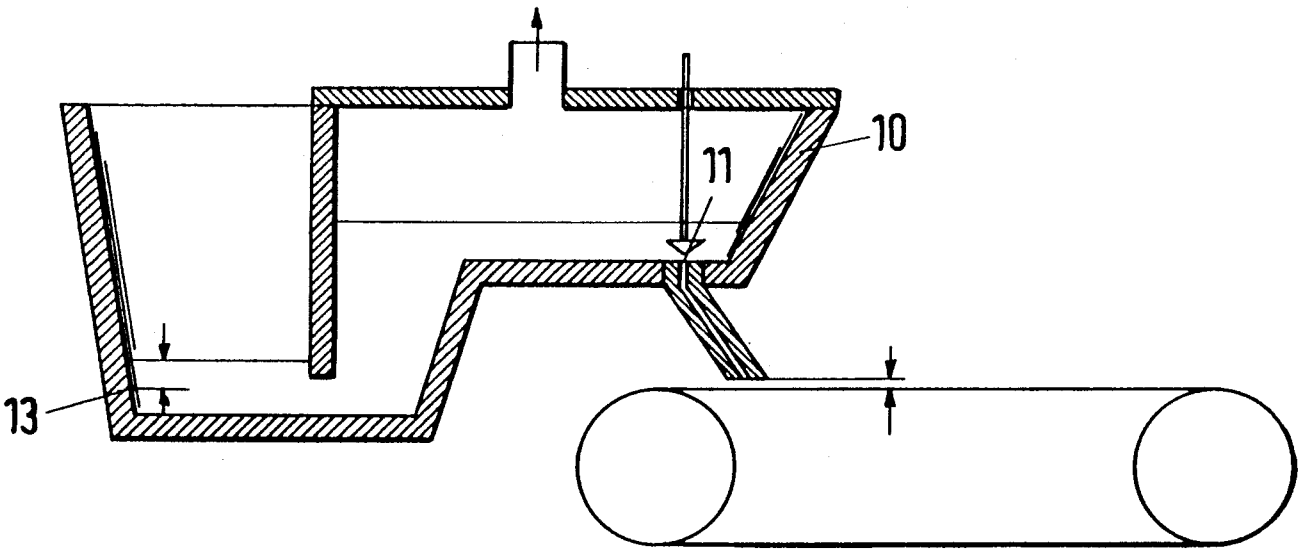
FIG. 2 is a cross-sectional representation of an alternative embodiment of a distributor portion of the instant invention.

In FIG. 2, the method of the instant invention is employed for determining and regulating the level of molten metal in a bath contained in a distributor 10 in which the amount of metal discharged from the distributor 10 is controlled as a function of the height of the molten metal in the distributor 10. In this case, the introduction of inert gas preferably occurs in the vicinity of the outlet 11 or at the bottom of the distributor 10 at the point 13.

In FIG. 2, the introduction of inert gas is provided externally on the outside utilizing the control and measuring devices shown in FIG. 1. The setting signal can in this connection act on the adjustment of a tipping angle of the distributor or on the pressure acting on the surface of the bath.

Figure 3:
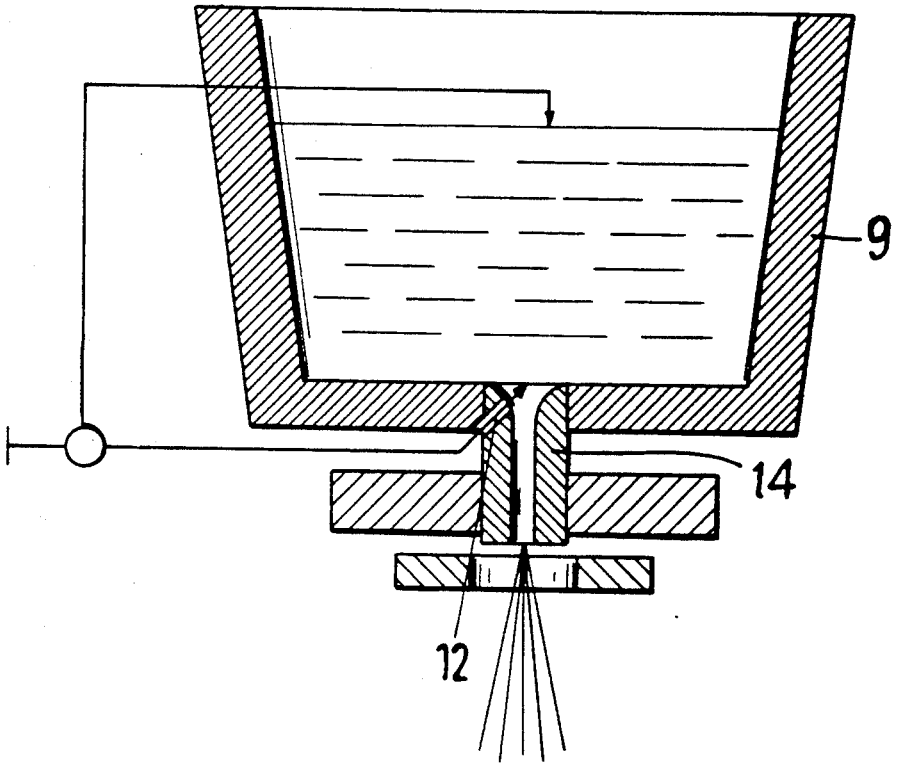
FIG. 3 is a cross-sectional representation of another alternative embodiment of a distributor portion of the instant invention especially adapted for spray compacting.

FIG. 3 shows the use of the method of the present invention in spray compacting. In this embodiment, the inert gas is introduced through the conduit 12 shown in the discharge brick 14 of the vessel 9. The ferrostatic pressure is, in this case, the controlling pressure and determines the amount of molten metal emerging from the outlet. The external feed of inert gas as well as the measurement and control devices are employed in the same manner as they are shown in FIG. 1. In order to keep the operating parameters constant in the method shown in FIG. 3, the setting signal acts on the rate of removal or the rate of withdrawal of the emerging metal.

In the embodiment shown in FIG. 3, since the vessel containing the molten metal is not refilled as the molten metal is sprayed out the bottom, it is important that the introduction of the inert gas together with the corresponding measurement of the absolute pressure and of the flow be carried out quasi-continuously during the discharge. In this connection, the necessity becomes highlighted that at every moment at which the absolute pressure is recorded and evaluated for the determination of the height of the level of the bath, the flow of inert gas just exceeds a value of zero. Measurements are taken at the arrow points in FIG. 3 and compared as shown above.

As is clear from the individual examples and embodiments described herein, the inventive method for determination and regulation of the level of the molten metal has a wide field of use. Accordingly, while there have been shown, described and pointed out the fundamental novel features of the invention as applied to preferred embodiments thereof, it will be understood that various omissions, substitutions and changes in the form and details of the methods and devices illustrated may be made by those skilled in the art without departing from the spirit of the invention. It is the intention, therefore, to be limited only as indicated by the scope of the claims appended hereto.

We claim:

1. A method of determining and regulating one of the level of molten metal in a bath contained in a metallurgical vessel and the amount of molten metal withdrawn from the vessel and which has a pressure acting on the surface of the bath, comprising:

introducing an inert gas flow into said molten metal bath and below the surface thereof at a location in said vessel;

determining the absolute pressure of the inert gas flow through said molten metal other than zero flow;

measuring the pressure acting on the surface of said bath;

determining the difference between said surface pressure and said absolute pressure and converting said difference into a distance measurement reflecting the actual distance between the surface of said bath and the location of introduction of said gas flow below said surface into said bath;

comparing said distance measurement with a predetermined desired distance value and forming a resultant measurement therefrom; and regulating as a function of said resultant measurement one of the level of the bath and the amount of molten metal withdrawn from said vessel.

2. The method of claim 1, wherein said molten metal is introduced into said bath through a feed pipe having an end that is immersed in said bath, and said inert gas flow is introduced at said end.

3. The method of claim 1, wherein said inert gas flow is introduced at the bottom of said molten bath.

4. The method of claim 1, wherein said metallurgical vessel is an open-ended mold in a casting plant.

5. The method of claim 1, wherein said pressure acting on the surface of said bath is atmospheric pressure.

6. The method of claim 1, wherein said regulation of the level of said bath is accomplished by a setting member.

7. The method of claim 1, wherein the amount of molten metal withdrawn from said vessel is regulated by said resultant measurement.

8. The method of claim 1, further comprising the steps of:

converting said resultant measurement into an electrical signal; and feeding said electrical signal into a setting member for regulating one of the level of said bath and the amount of molten metal withdrawn from said vessel.

* * * * *